US006722580B1

(12) United States Patent
Fouillet et al.

(10) Patent No.: US 6,722,580 B1
(45) Date of Patent: Apr. 20, 2004

(54) LIQUID DROP EJECTION DEVICE

(75) Inventors: Yves Fouillet, Voreppe (FR); Muriel Moreau, Sassenage (FR)

(73) Assignee: Commissariat a l'Energie Atomique, Paris (FR)

( * ) Notice: Subject to any disclaimer, the term of this patent is extended or adjusted under 35 U.S.C. 154(b) by 0 days.

(21) Appl. No.: 09/936,031

(22) PCT Filed: Mar. 20, 2000

(86) PCT No.: PCT/FR00/00684

§ 371 (c)(1),
(2), (4) Date: Jan. 23, 2002

(87) PCT Pub. No.: WO00/56463

PCT Pub. Date: Sep. 28, 2000

(30) Foreign Application Priority Data

Mar. 23, 1999 (FR) ..... 99 03589

(51) Int. Cl.[7] ..... B05B 3/04

(52) U.S. Cl. ..... 239/102.1; 239/102.2; 239/81; 239/82; 239/85

(58) Field of Search ..... 239/102.1, 102.2, 239/81, 82, 85

(56) References Cited

U.S. PATENT DOCUMENTS

| | | | | |
|---|---|---|---|---|
| 4,015,914 A | | 4/1977 | Kushner et al. | |
| 4,293,866 A | | 10/1981 | Takita et al. | |
| 5,338,360 A | * | 8/1994 | Nilsson | 239/102.2 |
| 5,423,481 A | | 6/1995 | Thomas | |
| 6,196,219 B1 | * | 3/2001 | Hess et al. | 239/102.02 |

FOREIGN PATENT DOCUMENTS

| | | |
|---|---|---|
| DE | 43 14 343 A1 | 11/1994 |
| EP | 0 213 240 | 3/1987 |

* cited by examiner

*Primary Examiner*—Robin O. Evans
(74) *Attorney, Agent, or Firm*—Anderson Kill & Olick, P.C.; Eugene Lieberstein; Michael N. Meller

(57) ABSTRACT

This invention relates to a device for ejection of liquid drops comprising:

a non-deformable body (28) provided with a cavity, filled with the said liquid (20) and at least one output orifice (19) for this liquid;

means of transmitting a sufficiently large pulse to the liquid to cause ejection of at least one drop (26); these means include means (23) of striking a wall (30) of the said body (28).

1 Claim, 3 Drawing Sheets

LIQUID DROP EJECTION DEVICE

TECHNICAL FIELD

This invention relates to a device for the ejection of liquid drops.

STATE OF THE PRIOR ART

Devices for ejection of liquid drops according to prior art comprise devices with continuous jets and devices with controlled drops. This invention is applicable only to devices with controlled drops, and they are used particularly for ink jet printer heads. They are subdivided into two main families:

devices with deformable membranes like those described in document reference [1] at the end of this description, in which ejection of a liquid drop is caused by the deformation of a membrane 11. As shown in FIG. 1, the volume of a cavity 12 delimited by this membrane 11 and filled with a liquid 13 through a pipe 14 is reduced when an actuator 10 acting on the said membrane 11 is energized. The compressibility of the liquid 13 is negligible, such that reducing the volume causes ejection of a liquid drop 15 through an opening or a "nozzle" 16. As described in document [2], this type of device is used particularly for biological applications. But they have many disadvantages and particularly including a deformable membrane makes the structures more fragile and frequently makes the technology complex. Furthermore, if the drops are to be ejected at high speed, the membrane deformation must be very fast, which requires an actuator with fast dynamics;

"bubble-jet" type devices like those described in document [3], in which ejection of a liquid drop 22 is also related to a variation of the volume of a cavity 18; but the ejection is then caused by local vaporization of the liquid. As shown in FIG. 2, the heating element 17 is placed close to the cavity 18 equipped with an opening 19 and filled with a liquid 20 supplied through a pipe 21. This type of devices is used particularly in office automation applications. But they require an increase in the temperature of the liquid medium, which can modify its characteristics and is therefore incompatible with biological applications.

The purpose of this invention is a device for ejection of liquid drops in order to overcome the disadvantages of devices according to prior art, while proposing an easy-to-make structure with very fast dynamics, and resisting high liquid pressures without increasing the temperature of the liquid.

DESCRIPTION OF THE INVENTION

This invention relates to a device for ejection of liquid drops comprising:

a body provided with at least one cavity filled with the said liquid and an outlet orifice for this liquid;

means of transmitting a sufficient force to the liquid to eject at least one drop; characterized in that the body is not deformable and that these means comprise means of striking a wall of the said body.

Unlike devices according to known art in which the ejection devices with simultaneous ejections provide a cavity and a striking device for each orifice, the invention can associate several orifices with a single cavity and a single striking device.

In a first embodiment, the striking means comprise a metallic mass moved by an electromagnet, the mass then moving along the centerline of the cavity output orifice.

Advantageously, the cavity may be made in a silicon substrate. For example, the cavity may be of the order of a few millimeters wide and the orifice may be of the order of 200 $\mu$m wide. For other applications, the width of the same cavity may be about 60 $\mu$m.

In this first embodiment, the consumable part of the device is composed of the substrate alone. With this consumable part which is easy to make, operating costs are minimized.

In one variant of this first embodiment, the cavity forms a capillary located between a microfluidic system on the upstream side and a microfluidic system on the downstream side, the mass moving in the direction perpendicular to the cavity. The diameter of the cavity is then between a few micrometers and a few hundred micrometers.

This first embodiment makes it possible to eject drops without adding a deformable membrane and without adding active elements machined on the substrate.

In a second embodiment, the striking device comprises at least one flexible arm that supports a mass and an electrostatic actuator. In one variant of this embodiment, the cavity forms a capillary located between a microfluidic system on the upstream side and a microfluidic system on the downstream side.

With this second embodiment, the device according to the invention can be miniaturized.

The device according to the invention may be different sizes, but it is particularly attractive if it is miniaturized. The objective is then to eject drops with very small volumes (less than 1 $mm^3$). Advantageously, the device according to the invention can then be manufactured using the same technology, for example a "silicon" type technology.

The device according to the invention can be used in many different fields; for example for printer heads, or for biological applications with micropipettes for analysis, or liquid deposition systems or systems for deposition of chemical or biological reagents onto biochips, or for the distribution of a liquid in the form of droplets (injectors, etc.).

BRIEF DESCRIPTION OF THE DRAWINGS

The drawings are not drawn to scale to improve clarity.

DETAILED DESCRIPTION OF EMBODIMENTS

Figure 1:
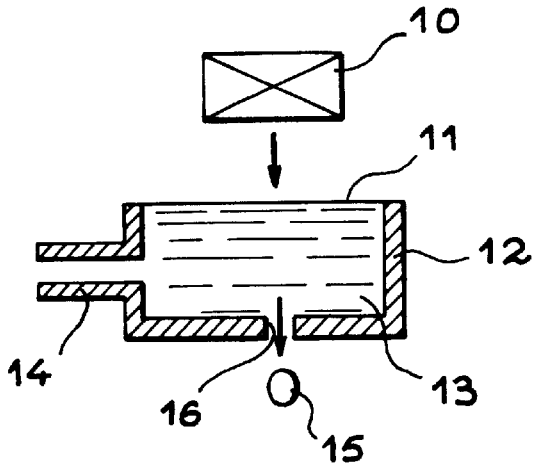
FIGS. 1 and 2 illustrate two devices for ejection of liquid drops according to known art.
Figure 2:
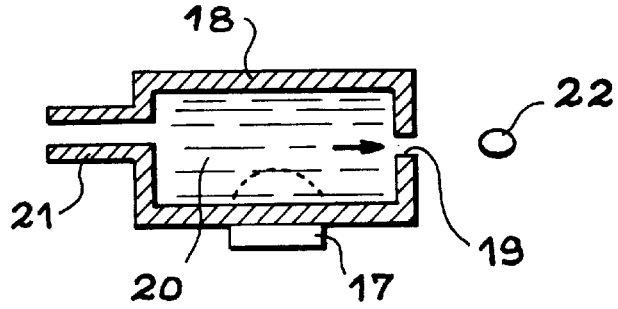
Figure 3:
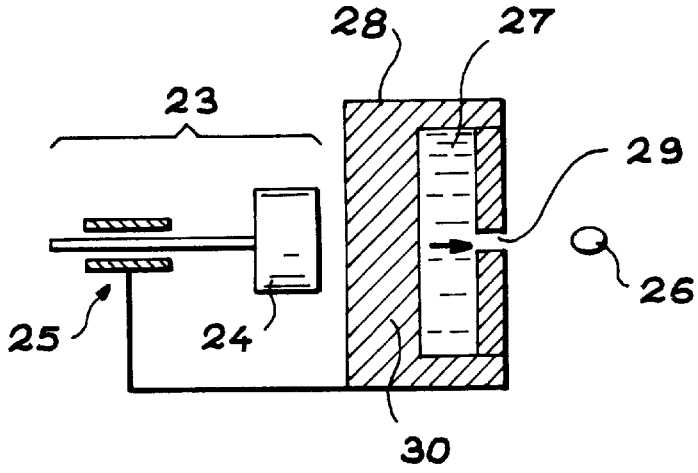
FIG. 3 illustrates the liquid drop ejection device according to the invention.

As shown in FIG. 3, the liquid drop ejection device according to the invention comprises:

a non-deformable body 28 provided with a cavity filled with a liquid 27 and one (or several) orifices or nozzles 29, this body having a solid wall 30;

a device 23 for striking this wall 30, comprising a mass 24 moved by an actuator 25.

The actuator 25 acts on the mass 24 such that it strikes the wall 30 in a movement along the axis of the nozzle 29.

The propagation of the shock through the wall 30 and the liquid 27 causes the ejection of one (or more) drops 26 of liquid. In an ideal case, the physical phenomena involved could be assumed to be the same as for an elastic shock, particularly because the various parts of the device involved in shock propagation will be less absorbent. In particular, a rigid wall will be more efficient in transmission of energy.

In general, the device is optimized by the choice of materials, dimensions and an appropriate architecture, such that the cavity does not deform under the shock of the striker and the energy is transmitted efficiently between the striker and the liquid.

Figure 4:
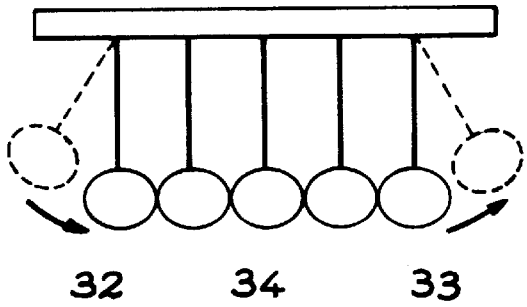
FIG. 4 illustrates a pendulum according to known art.

The principle of this type of mechanical shock which is well known in mechanics, can be diagrammatically illustrated using the pendulum in FIG. 4. Due to the conservation of the quantity of movement and energy, the movement applied to the first ball 32 is transmitted to the last ball 33 without disturbing the intermediate balls 34. The mechanisms involved in the formation of a drop are complex and involve viscosity and capillarity phenomena. But, by analogy and macroscopically, we can compare the liquid 27 contained in the cavity with this pendulum. Thus, by analogy and macroscopically, the liquid 27 contained in the cavity may be treated like this pendulum. A shock applied to wall 30 is propagated through the thickness of the material and then into the liquid 27, finally ejecting a drop 26 through the orifice 29 in the cavity.

In a first embodiment, the device according to the invention may be an add-on striking device, in other words independent of the cavity containing the liquid.

Figure 5:
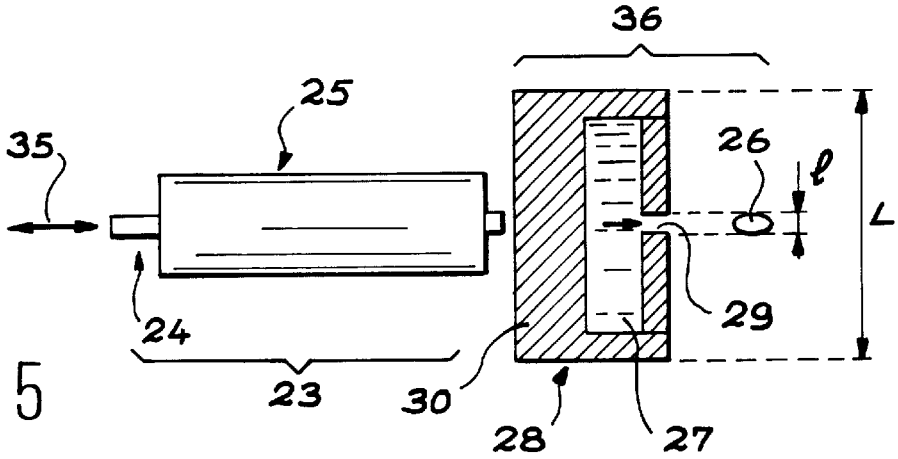
FIGS. 5 and 6 illustrate two example embodiments of liquid drop ejection devices with add-on percussion according to the invention.
Figure 6:
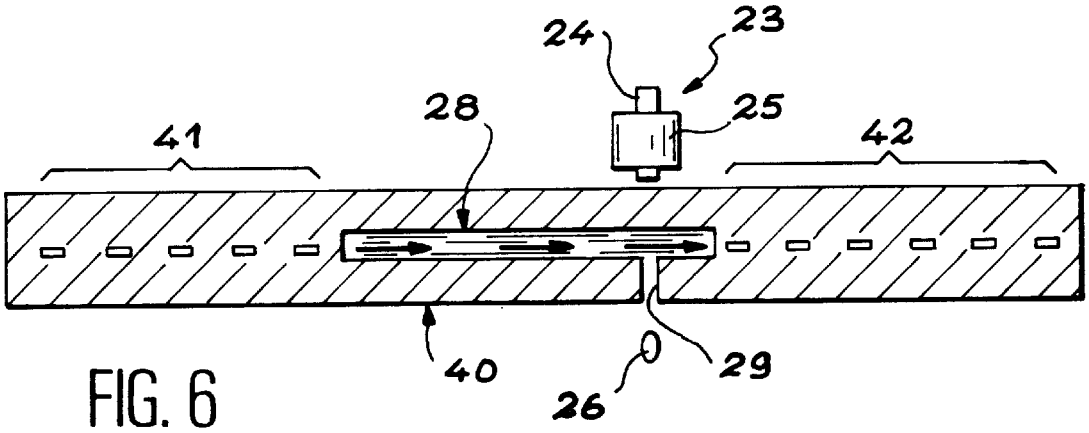

As shown in FIG. 5, the striking system 23 may for example be composed of a metallic mass 24 located in the field of an electromagnet 25. When acted upon by the electromagnet, the mass can follow a to-and-fro movement 35 and strike the wall 30 thus causing ejection of liquid drops 26.

Other striking devices 23 are obviously possible; piezoelectric, pneumatic, electric, etc.

The body that forms the head 36 may be produced in a silicon wafer or any other machinable material, for example glass, quartz or plastic. It then comprises an orifice 29, the shape of the nozzle of this orifice being obtained by etching. It may also be fitted with another orifice, not shown in the figure, for the liquid supply. The dimensions L (width of body 28) and l (width of orifice 29) may be of the order of a few millimeters and about 200 $\mu$m respectively.

In one variant of this embodiment, the cavity is in the shape of a capillary made in a substrate 40 located between a microfluidic system on the upstream side 41 and a microfluidic system on the downstream side 42. The striking device 23 is then placed perpendicular to the cavity. The diameter of the cavity may then be between a few micrometers and a few hundred micrometers.

A microfluidic system is a fluid manipulation system (pumps, filters, mixers, etc.), or a chemical or biochemical reaction system, or a measurement or detection system, etc.

For example, this type of microfluidic systems may be a microfluidic system for a biological analysis. These are called "$\mu$ TAS" systems (for $\mu$ Total Analysis System) or "Lab-on-ship".

In a second embodiment, the device according to the invention may also be an integrated striking device, integrating the striking device directly on the substrate of the cavity.

Figure 7:
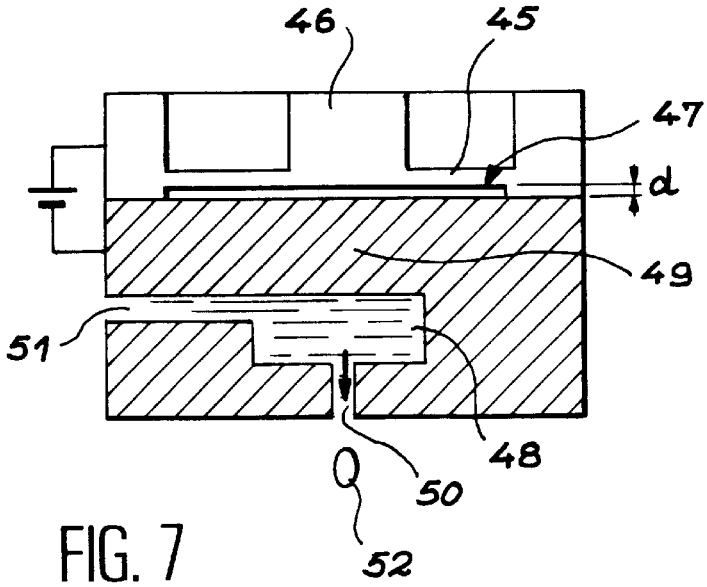
FIGS. 7 and 8 illustrate two example embodiments of liquid drop ejection devices with integrated percussion according to the invention.

As shown in FIG. 7, the striking device comprises flexible arms 45, for example membranes, that support a mass 46 and an electrostatic microactuator 47. This figure also shows the cavity 48 and its rigid wall 49, the orifice or nozzle 50, a liquid transport pipe 51, and the ejected drop 52.

With this type of embodiment, the device according to the invention can be miniaturized. The principle of electrostatic bonding is then used to strike the mass 46, and the mass is also integrated in the cavity substrate. The flexible arms 45 may be also engraved in the substrate. The electrostatic force is $1/d^2$ where d is the air gap in the electrostatic actuator 47, such that the velocities and therefore the energies are high at the time of the shock.

Figure 8:
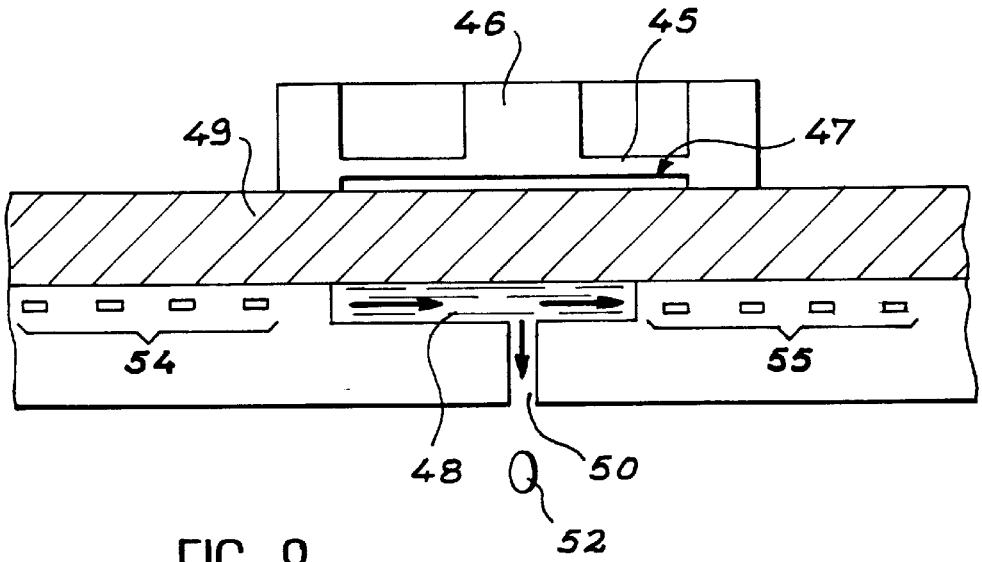

FIG. 8 illustrates a variant of this embodiment using a microfluidic system on the upstream side 54 and a microfluidic system on the downstream side 55 laid out on each side of the cavity 48 in capillary form. The microfluidic systems are then integrated in a support that acts as an intermediate role between the mass and the capillary.

REFERENCES

[1] "Microdosage of Liquids By A Free Jet Comprising Extraordinary Operating Range" by N. Hey, M. Freygang, H. Gruhler, H. Sandmaier and R. Zengerle (Actuator 98, 6$^{th}$ International Conference on New Actuators, Jun. 17–19 1998, Bremen, Germany, pages 111 to 113)

[2] "High-Density Oligonucleotide Arrays" by A. P Blanchard, R. J Kaiser & L. E Hood (Biosensors & Bioelectronics, volume 11, No. 6/7, pages 687–690, 1996)

[3] U.S. Pat. No. 5,041,844

What is claimed is:

1. Device for ejection of at least one drop of a liquid comprising:

a body provided with a cavity filled with said liquid and at least one output orifice through which drops of liquid can be ejected with said body having a rigid wall;

means to cause ejection of at least said one drop of liquid through said output orifice, with said means including a movable mass for striking said wall during movement to cause the propagation of a shock by said mass which propagates through the wall and liquid in the cavity, wherein the body and cavity are non-deformable from the shock applied by the mass and means for causing said mass to move so as to strike said wall during moving in one direction and to withdraw from said wall in another direction in which the cavity is made in a silicon wafer.

* * * * *